United States Patent [19]

Jones

[11] Patent Number: 4,655,051

[45] Date of Patent: Apr. 7, 1987

[54] HEAT EXCHANGE SYSTEM WITH REVERSING RECEIVER FLOW

[75] Inventor: Richard D. Jones, Springfield, Va.

[73] Assignee: UHR Corporation, Alexandria, Va.

[21] Appl. No.: 801,946

[22] Filed: Nov. 26, 1985

[51] Int. Cl.[4] ..... F25B 13/00

[52] U.S. Cl. ..... 62/324.4; 62/509

[58] Field of Search ..... 62/324.4, 509

[56] References Cited

U.S. PATENT DOCUMENTS

| | | | |
|---|---|---|---|
| 1,946,328 | 2/1934 | Neff | 62/509 |
| 2,137,902 | 11/1938 | Walter | 62/509 X |
| 2,799,142 | 7/1957 | Schubert et al. | 62/509 X |
| 4,106,307 | 8/1978 | Matsuda | 62/324.4 |
| 4,231,229 | 11/1980 | Willitts | 62/509 X |
| 4,242,873 | 1/1981 | Hino | 62/324.4 |
| 4,484,452 | 11/1984 | Houser, Jr. | 62/174 |
| 4,528,822 | 7/1985 | Glamm | 62/238.7 |

OTHER PUBLICATIONS

AC & R Components, *Henry*, Drawing No. SP500.

The Trane Company, *Trane Air Conditioning Manual*, Chapter VI, p. 191.

*Copeland Refrigeration Manual*, part 2, section 11, p. 11-1.

*Standard Liquid Receivers*, catalog RC-856, section III.

*Primary Examiner*—Lloyd L. King

*Attorney, Agent, or Firm*—Walter C. Farley

[57] ABSTRACT

A heat exchange system includes a compressor, heat exchangers, an expansion valve, a receiver and a reversing valve connected so that refrigerant can flow in either direction through the receiver, depending upon the direction of heat exchange. One embodiment of a receiver for the system includes a chamber with a first conduit connected to the top thereof and a second conduit connected to the bottom. The inner ends of the two conduits are substantially flush with the inner surfaces of the respective walls. The receiver is connected into the system so that the upper conduit acts as an inlet during cooling and an outlet during heating, the lower conduit performing the reverse functions. A second embodiment has both inlet-outlet conduits in the upper wall portion.

8 Claims, 6 Drawing Figures

HEAT EXCHANGE SYSTEM WITH REVERSING RECEIVER FLOW

This invention relates to an improved heat exchange system and a receiver for a heat exchange system of the type using a refrigerant medium, and particularly a system which is configured to be usable for both heating and cooling.

BACKGROUND OF THE INVENTION

As its name implies, in a system which uses refrigerant as part of the heat exchange medium in a heating and cooling system, a receiver is used to hold refrigerant. Under normal operating conditions of a conventional refrigeration system which is unidirectional (i.e., is not a heat pump and does not reverse its cycle) a receiver is used to contain liquid refrigerant throughout the entire operational cycle of the system. Generally speaking, such a system operates under various operating conditions which change as a result of changes in environmental conditions. For example, if we assume that a space-cooling system begins operation when the exterior ambient temperature is 90° F. and the interior temperature is 70° F., a specific set of operating conditions will exist and the condensing and evaporating medium for the system will have certain mass flow requirements. If the exterior ambient then goes to 80° F., the mass flow requirements which are necessary for the system to be able to perform its function in a manner which does not exceed the operating limits of the system are significantly different. Because the mass flow characteristics change from time to time, there must be a holding area for the refrigerant which is not being circulated under some conditions and that holding area is commonly a receiver.

Typically, a receiver consists of a cylindrical chamber such as chamber 10 in FIG. 1 having an inlet tube 12 connected to the top wall 13 of the chamber and an outlet dip tube 14 which extends through the top wall and terminates near the bottom wall 16 of the chamber. Liquid arriving from a condenser in the system enters through tube 12 in the top wall and, under a specific set of operating conditions, a relatively stable liquid level 15 is established within the receiver. Liquid leaves the receiver through tube 14, the lower end of which is positioned so that it is below the top of the liquid level under all normal, design operating circumstances. The size and configuration of the receiver can vary substantially, depending upon the requirements of the remainder of the system. A common rule of thumb among air conditioning engineers is that the receiver must be large enough to hold the total amount of refrigerant used in the system. Commonly, a sight glass 18 is provided so that the liquid level can be observed to establish that a sufficient quantity of refrigerant exists in the system.

Whenever a receiver of the conventional type is used in a refrigeration system, there is no concept of employing the phenomenon known as subcooling in the refrigeration system. Subcooling would be advantageous in normal refrigeration design because it assures, or approaches assuring, that the refrigerant entering the thermostatic expansion valve is a liquid which is of zero quality, meaning that there is no gas suspended in the refrigerant. However, when a liquid level is established in a receiver as illustrated at 15 in FIG. 1, there is necessarily a body of gas in the space 18 above the liquid. Any time a liquid is present with its gas, the liquid cannot be subcooled. Thus, the liquid is at a saturated temperature corresponding to the pressure of the gas above that liquid surface. FIG. 1 indicates a static condition. As the arrows indicate, liquid is entering through tube 12 and exiting through tube 14. Conventional wisdom would dictate that one not try to reverse the functions of these tubes, pumping refrigerant in through tube 14 and extracting through tube 12 because the substance extracted would be only gas unless the liquid level were to be raised to the point at which it reaches the top wall 13 of the chamber and this would be viewed as an inefficient way to operate the system. Thus, it would be completely contrary to standard practice to place a receiver in a system in a position such that refrigerant was being forced in through the dip tube 14 and caused to leave through a tube in the position of tube 12.

It has been found, however, that certain systems which are intended to operate under widely varying sets of operating conditions have system requirements which are not satisfied by the receivers of the prior art. It is highly desirable to have the receiver in the stream continuously so that it can respond to changing system requirements by adding or subtracting refrigerant from the system quickly and automatically. Efforts to provide some apparatus to accommodate the changing refrigerant requirements have involved complicated arrangements with complex control devices such as multiple solenoid valves, and have uniformly used receivers in such a way that therethrough is confined to one direction.

SUMMARY OF THE INVENTION

Accordingly, an object of the present invention is to provide a heat exchange system in which refrigerant flow is bidirectional, depending upon the direction of heat exchange.

Another object of the present invention is to provide a receiver configuration which permits retention of varying amounts of refrigerant to accommodate various operating requirements, the quantity being variable to nearly zero.

Briefly described, the invention includes a system including a compressor, first and second heat exchangers, an expansion valve, a receiver, flow reversing means and conduit means interconnecting those components to form a refrigerant-containing system in which heat can be transferred in either direction between said exchangers. The flow reversing means and receiver are positioned in the system so that reversal of the direction of refrigerant flow accompanies reversal of the direction of heat exchange.

BRIEF DESCRIPTION OF THE DRAWINGS

In order to impart full understanding of the manner in which these and other objectives are attained in accordance with the invention, particularly advantageous embodiments thereof will be described with reference to the accompanying drawings, which form a part of this specification, and wherein.

DESCRIPTION OF THE PREFERRED EMBODIMENT

The present invention will be discussed in the context of a bidirectional heat exchange system illustrated in FIG. 2. It should be understood, however, that the FIG. 2 system is but one form of system in which the concept of the invention can be used and is by no means the only form of such a system.

Figure 1:
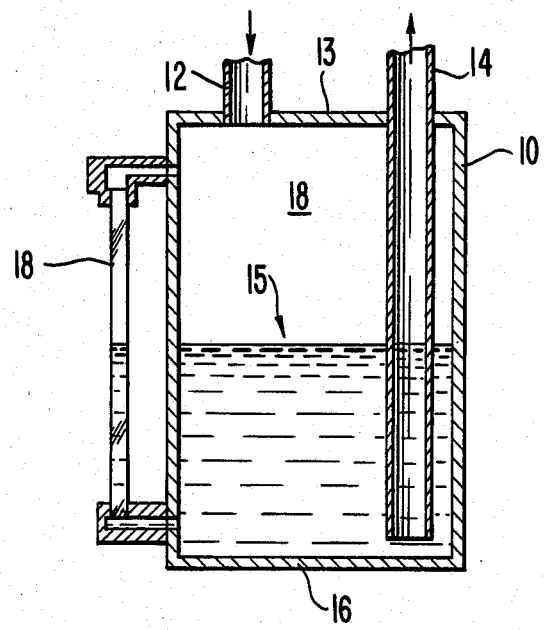
FIG. 1. (PRIOR ART)
FIG. 1 is a side elevation, in section, of a prior art receiver.
Figure 2:
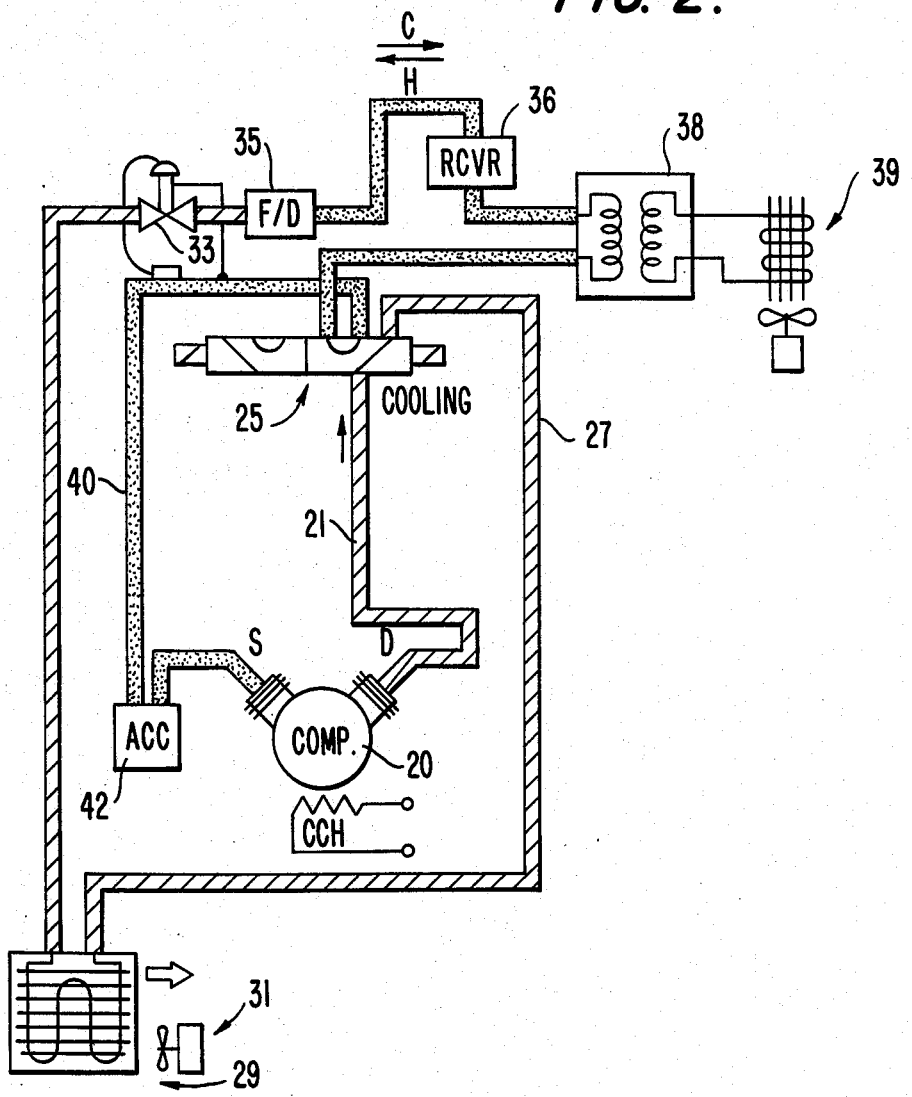
FIG. 2 is a simplified schematic diagram of a reversible heating and cooling system in accordance with the present invention.

The system of FIG. 2 is a system for heating or cooling an interior space and includes a compressor 20 having a discharge outlet connected by a conduit 21 to a reversing valve 25 which is shown in its cooling position. Valve 25 is a conventional type of valve which is normally operated by solenoids and can be moved to either of two positions to establish an appropriate direction of refrigerant flow for the desired direction of heat exchange. In the cooling position, conduit 21 from compressor 20 is connected by valve 25 to a conduit 27 which leads to one port of the refrigerant side of an outdoor refrigerant-to-air heat exchanger 29 having a fan 31. The other port of the refrigerant side of exchanger 29 is connected through an expansion valve indicated generally at 33 and through a filter-dryer unit 35 to receiver 36, which is constructed in accordance with the invention as will be further described, for substantially continuous mass flow in one direction while the system is operating. The other side of receiver 36 is connected to one inlet of the refrigerant side of an exchanger 38, the other side of which is connected to a specific load device such as an exchanger 39 for heating or cooling a space. The other port of the refrigerant side of exchanger 38 returns to valve 25 which, in the cooling mode, couples it to a conduit 40 leading to an accumulator 42 the other side of which is connected to the suction side of compressor 20.

In the heating mode, conduit 21 is connected through valve 25 to exchanger 38 and then to the receiver, the substantially continuous mass flow through the receiver thus being in the opposite direction. This is schematically indicated by the arrows above receiver 36 which identify the directions of flow for the cooling and heating modes with the letters "C" and "H", respectively.

In a system of this type, a receiver is necessary in order to provide a storage location for the refrigerant in the heating mode, the mass flow requirements of which are smaller than in the cooling mode. Additionally, this need for a receiver can be compounded by such conditions as the heat exchange surfaces on the indoor and outdoor heat exchangers being vastly different. Because of that, the requirement for refrigerant to be held in one of those two heat exchangers in specific modes varies widely over the operating range. It also varies widely between heating and cooling. Thus, the refrigerant is circulated throughout the system in the cooling mode but it is necessary to hold the refrigerant somewhere when the system is in the heating mode.

Figure 3:
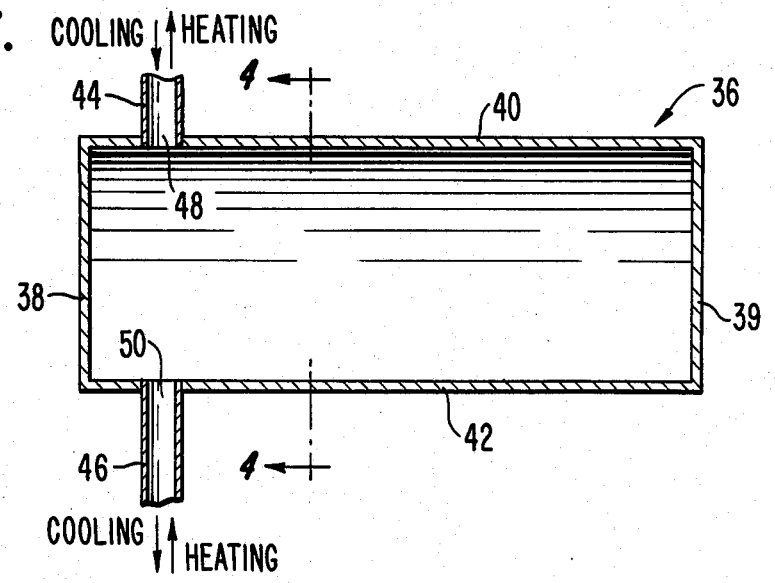
FIG. 3 is a side elevation, in section, of one embodiment of a receiver in accordance with the invention.
Figure 4:
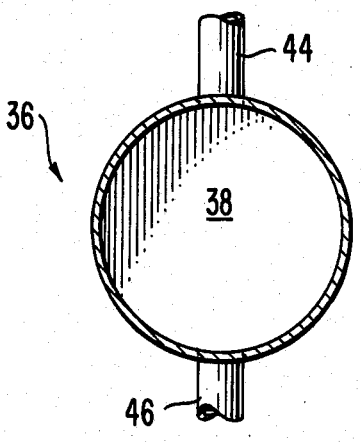
FIG. 4 is an end elevation, in section, along the line 4—4 of FIG. 3.

Receiver 36, connected by the various conduits in the system of FIG. 2 in combination with the reversing valve 25, performs these necessary functions. As shown in FIGS. 3 and 4 a suitable receiver comprises a circular cylindrical chamber having its central axis disposed in a substantially horizontal plane. The chamber has end walls 38 and 39 and a cylindrical side wall having an upper portion 40 and a lower portion 42. A first conduit 44 penetrates upper wall portion 40 and is fixedly attached thereto, and a second conduit 46 similarly penetrates the lower wall portion 42 and is attached therein. While these conduits are shown in an aligned, coaxial relationship, this is not essential.

It is, however, important for the inner end of conduit 46 to terminate closely adjacent the inner surface of the wall portion 42 in which it is attached. The end surface 48 of conduit 44 is substantially flush with the inner surface of wall portion 40, but more importantly the inner surface 50 if conduit 46 is similarly substantially flush with the inner surface of wall portion 42. It is particularly important for surface 50 to not protrude significantly into the interior of the chamber, although surface 48 can protrude therein to a small extent without impairing the function of the receiver. As seen in FIG. 4, conduit 46 is at the lowest point of wall portion 42.

Above and below conduits 44 and 46, respectively, are arrows indicating the directions of flow during cooling and heating modes, respectively. As will be recognized from these arrows, fluid flowing into conduit 44 during the cooling mode enters the interior of chamber 36 and can flow out of conduit 46. Fluid flowing into conduit 46 during the heating mode enters the chamber and leaves under some pressure through conduit 44.

With an appropriate amount of refrigerant in the system, it is undesirable to retain liquid refrigerant inside the receiver under a wide range of operating conditions until all of the refrigerant is liquid. Although the operation of this receiver is not fully understood, the process apparently involves refrigerant flowing into the receiver, possibly performing expansion in the receiver to some extent and creating considerable bubbling of the refrigerant within the chamber. Apparently, this bubbling of the refrigerant causes enough turbulence to take place inside the receiver so that the mixture which leaves the receiver includes both refrigerant liquid and gas with the mass flow out being essentially the same as the mass of the mixture which entered. An important feature of this operation is that the ratio of gas to liquid leaving the receiver remains rather constant from moment to moment. This ratio and the velocity of flow will change as operating conditions change, but this occurs slowly. There is thus no cyclic phenomena in which large liquid slugs or large gas slugs are trying to flow through the thermostatic expansion valve 33 in the system as often occurs in prior art systems. Rather, mixtures as described above are caused to flow therethrough. This phenomenon is quite probably based on the volumetric ratio between the refrigerant gas and the refrigerant liquid. During heating, for example, the volumetric ratio of gas to liquid, which can be between 40 and 100, increases the velocity of flow to the extent that the resulting turbulence probably causes the liquid to be suspended long enough to exit the upper tube in essentially the same gas to liquid proportion from moment to moment, as is the liquid to gas proportion entering through the bottom tube. Regardless of what theoretical explanation is correct, it has been found that this receiver functions extremely well.

In the cooling mode a considerable quantity of refrigerant must exist in the outdoor coil but it is not necessary that refrigerant be held in the receiver. Correspondingly, the direction of the refrigerant flow is reversed with the result that the refrigerant flows in the top tube and out of the bottom tube and very little is retained within the chamber 36. In the heating mode, as much as 6–8 pounds of refrigerant can be retained within the receiver. In the cooling mode, however, the receiver probably holds less than 0.5 pounds.

As may be recognized by those skilled in the art from the above discussion, the thermostatic expansion valve used with this receiver arrangement must be sized accordingly. Not only should the valve orifice be larger than normal for the system capacity but it is also desirable to choose a valve having a wide range of control.

It should be noted that the relative positions of the thermostatic expansion valve and the receiver can be changed to achieve optimum operation depending on the characteristics of the system or the operating conditions. As one example, which will be recognized by those skilled in the art, if the charge imbalance in the system exists because the outdoor heat exchanger is smaller than the indoor heat exchanger, the expansion valve would be placed between receiver 36 and exchanger 38.

A further advantage of the receiver arrangement in accordance with the invention is that the amount of the refrigerant charge is somewhat less critical. A variation of as much as 3–5 pounds of charge inside the receiver (i.e., 50% or more) can still permit operation such that the flow of liquid and gas out of the receiver is in essentially the same proportion over a span of time. A receiver can thus be incorporated in this fashion in a heat pump and holds excess amounts of refrigerant in a way which has been attempted before using multiple solenoid liquid valves and other techniques. However, such systems are very complicated and require complex control devices.

Figure 6:
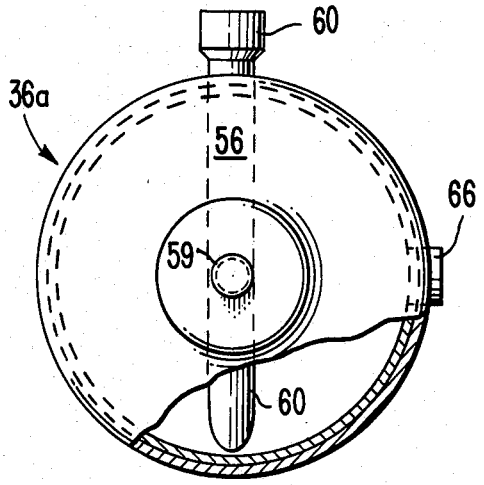
FIG. 6 is an end elevation, partially cutaway, of the structure of FIG. 5.
Figure 5:
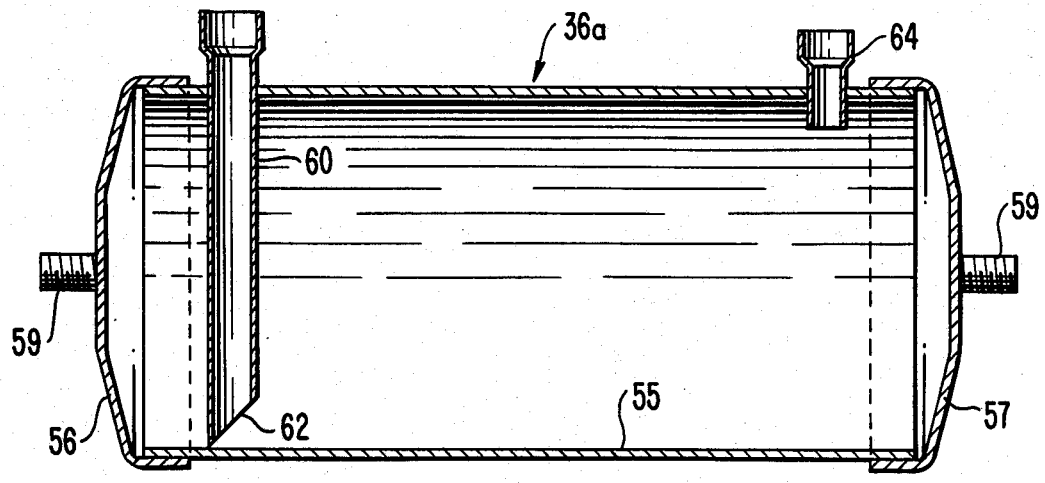
FIG. 5 is a side elevation, in section, of a second embodiment of a receiver usable in the system of FIG. 2.

A further embodiment of a receiver **36*a* usable in the system of FIG. 2 is shown in FIGS. 5 and 6 wherein a cylindrical housing 55 has end caps 56 and 57 fixedly attached thereto. Each end cap has a threaded stud 59** for mounting the receiver.

An inlet-outlet tube 60 extends through and is fixedly attached to the upper portion of one end of housing 55 and extends to the inner surface of the bottom portion of the housing. The lower end 62 of tube 60 is cut diagonally at an angle of about 45° so that liquid near the bottom of the housing can be withdrawn if conditions are such that a gravity-created liquid pool exists as may be true in the cooling mode. A second inlet-outlet tube 64 extends through the upper portion of the other end of housing 55 and is fixedly attached therein. The tubes are attached, of course, in a sealed fashion as by brazing or soldering. Tube 64 extends inwardly for only a short distance. A safety plug 66 is mounted in the side of housing 55.

While certain advantageous embodiments have been chosen to illustrate the invention, it will be understood by those skilled in the art that various changes and modifications can be made therein without departing from the scope of the invention as defined in the appended claims.

What is claimed is:

1. A heat exchange system comprising
a compressor;
first and second heat exchangers;
an expansion valve;
a receiver;
flow direction reversing means; and
conduit means interconnecting said compressor, said heat exchangers, said expansion valve, said receiver and said reversing valve to form a system containing refrigerant in which heat can be exchanged in either direction between said exchangers,
said flow direction reversing means and said receiver being positioned in said system so that said reversing means controls the continuous flow of refrigerant in one direction through said receiver during heat exchange in a first direction and through said receiver in the opposite direction during heat exchange in the second direction and so that the proportion of liquid to gas entering said receiver is always substantially equal to the proportion of liquid to gas leaving said receiver during heat exchange in either direction.

2. A system according to claim 1 wherein said receiver comprises
a closed chamber having a top wall portion and a bottom wall portion;
a first inlet-outlet conduit connected to said top wall portion in communicating relationship with the interior of said chamber; and
a second inlet-outlet conduit connected to said bottom wall portion in communicating relationship with the interior of said chamber, said second conduit having an end surface at a location closely adjacent the inner surface of said bottom wall portion.

3. A system according to claim 2 wherein said chamber comprises a cylindrical tank having a longitudinal central axis of rotation lying in a substantially horizontal plane under operating conditions.

4. A system according to claim 2 wherein said second conduit penetrates said lower wall portion at the lowest point thereof.

5. A system according to claim 2 wherein said first conduit has an end surface closely adjacent the inner surface of said top wall.

6. A system according to claim 1 wherein said receiver comprises a closed chamber having a top wall portion and a bottom wall portion; and
first and second inlet-outlet conduits connected through said top wall portion in communicating relationship with the interior of said chamber, said first inlet-outlet conduit having an end surface closely adjacent the inner surface of said bottom wall portion.

7. A system according to claim 1 wherein said receiver is positioned on the low pressure side of said expansion valve in the cooling mode and on the high pressure side of said expansion valve in the heating mode.

8. A heat exchange system according to claim 1 wherein said receiver comprises
a closed chamber having a top wall portion and a bottom wall portion,
a first inlet-outlet conduit connected into said top wall in communicating relationship with the interior of said chamber, said first conduit having an end surface closely adjacent the inner surface of said top wall;
a second inlet-outlet conduit connected to said bottom wall in communicating relationship with the interior of said chamber, said second conduit having an end surface at a location closely adjacent the inner surface of said bottom wall portion; and
said conduit means including means for connecting said receiver in said system such that during a cooling mode of operation said first conduit functions as an inlet conduit for said receiver and, during a heating mode, said upper conduit functions as an outlet conduit and said lower conduit functions as an inlet conduit for said receiver.

* * * * *